US006065535A

United States Patent [19]

Ross

[11] Patent Number: 6,065,535

[45] Date of Patent: May 23, 2000

[54] FORMATION FRACTURING AND GRAVEL PACKING TOOL

[75] Inventor: Colby M. Ross, Carrollton, Tex.

[73] Assignee: Halliburton Energy Services, Inc., Dallas, Tex.

[21] Appl. No.: 09/371,690

[22] Filed: Aug. 10, 1999

Related U.S. Application Data

[62] Division of application No. 08/932,458, Sep. 18, 1997, Pat. No. 5,964,296.

[51] Int. Cl.[7] ..... E21B 43/04; E21B 29/02

[52] U.S. Cl. ..... 166/51; 166/66.6

[58] Field of Search ..... 166/51, 250.15, 166/319, 374, 278, 66.6, 373; 175/38, 24

[56] References Cited

U.S. PATENT DOCUMENTS

| | | | |
|---|---|---|---|
| 3,313,349 | 4/1967 | Page, Jr. | 166/374 |
| 3,409,078 | 11/1968 | Knox et al. | 166/374 |
| 4,436,151 | 3/1984 | Callihan et al. | 166/154 |
| 4,722,392 | 2/1988 | Proctor et al. . | |
| 4,768,594 | 9/1988 | Akkerman | 166/319 |
| 4,840,229 | 6/1989 | Proctor et al. . | |
| 4,940,093 | 7/1990 | Hilsman, III | 166/319 |
| 5,048,611 | 9/1991 | Cochran | 166/374 |
| 5,473,579 | 12/1995 | Jeter | 175/50 X |
| 5,505,263 | 4/1996 | White et al. | 166/374 |
| 5,564,500 | 10/1996 | Rogers et al. | 166/312 |
| 5,636,691 | 6/1997 | Hendrickson et al. . | |

*Primary Examiner*—Frank S. Tsay
*Attorney, Agent, or Firm*—Paul I. Herman; Marlin R. Smith

[57] ABSTRACT

A service tool for use in completion operations includes a fluid control apparatus therein. The apparatus permits variable regulation of fluid flow downhole, selective opening and closing of multiple fluid ports in the apparatus, protection against overpressurization and communication with the earth's surface. Each of these functions is accomplished by displacing a member of the apparatus with an electromechanical device. In particular, data transmission is performed by displacing the member relative to a fluid port to thereby produce pressure pulses in a fluid flowing therethrough.

8 Claims, 4 Drawing Sheets

FORMATION FRACTURING AND GRAVEL PACKING TOOL

This is a division, of application Ser. No. 08/932,458, filed Sep. 18, 1997, now U.S. Pat. No. 5,964,296, such prior application being incorporated by reference herein in its entirety.

BACKGROUND OF THE INVENTION

The present invention relates generally to completion operations performed in subterranean wells and, in an embodiment described herein, more particularly provides a tool for use in these operations and methods of using same.

Completion operations in which a slurry is pumped down a tubing string to a formation intersected by a subterranean well are well known in the art. For example, formation fracturing and gravel packing operations each in part utilize slurry delivery to accomplish their objectives. In each of these operations, downhole fluid pressure at the point at which the slurry interfaces with the formation should be maintained within an appropriate range and varied as conditions dictate, and a fluid portion of the slurry may be returned to the earth's surface.

In some service tools used in fracturing operations, the tools may be configured to prevent return of the fluid portion during slurry delivery, so that the entire slurry is injected into the formation. In some of these tools, the tool may be manipulated by displacing the tubing string at the earth's surface to selectively permit return of the fluid portion to the earth's surface. Of course, since fluid return is typically via an annulus formed between the tubing string and casing lining the wellbore, return flow of the fluid portion therethrough may also be controlled at the earth's surface by utilizing a valve connected to the annulus at the earth's surface, however, this method requires applying relatively high pressure to the annulus and, therefore, is usually undesirable.

It would be useful to be able to selectively permit return of the fluid portion downhole, without requiring manipulation of the tubing string, and without requiring application of fluid pressure to the annulus. It would further be useful for the selection to be performed automatically, for example, in a combined fracturing and gravel packing operation, return of the fluid portion could be permitted automatically upon conclusion of the fracturing operation.

In some circumstances, it may be desirable to be able to regulate a rate of return of the fluid portion. Varying the rate of return of the fluid portion would permit corresponding regulation of the fluid pressure of the slurry downhole. It would also permit varying the rate of slurry particulate matter injected into the formation and/or deposited in the annulus.

Furthermore, particularly in fracturing operations, it is quite common for fluid pressure increases to be experienced near the end of the operation. These fluid pressure increases may be damaging to the downhole equipment and/or the well. What is needed in this circumstance is a way to immediately relieve the fluid pressure downhole, so that a fluid pressure increase does not exceed a predetermined maximum level.

In order to accurately monitor fluid properties near the formation during fracturing and/or gravel packing operations, a tool is needed that is able to communicate with the operator at the earth's surface. In this way, the operator would be able to adjust the operation in conformance with downhole conditions. The tool should include one or more sensors to sense the fluid properties, and a way to transmit data to the earth's surface.

From the foregoing, it can be seen that it would be quite desirable to provide a tool for use in wellsite operations which permits downhole regulation of fluid pressure, which permits selective return circulation, which is able to limit fluid pressure downhole, and which can communicate with the earth's surface. It is accordingly an object of the present invention to provide such a tool and associated methods of using the tool.

SUMMARY OF THE INVENTION

In carrying out the principles of the present invention, in accordance with an embodiment thereof, a service tool is provided which includes a fluid control apparatus. The apparatus performs several functions, yet is compact in configuration, and convenient and efficient in operation. The disclosed embodiment of the invention has the apparatus positioned at least partially in a fluid return flow passage of the service tool, wherein a fluid portion of a slurry is circulated back to the earth's surface.

In one aspect of the present invention, the apparatus includes a member attached to an electromechanical device. The electromechanical device is capable of causing displacement of the member to selectively permit or prevent fluid flow through a primary fluid port of the return flow passage. A fluid property sensor and a processor are interconnected to the electromechanical device, so that the member may be selectively displaced in response to a parameter, for example, a fluid property detected by the sensor, an elapsed time, etc.

In another aspect of the present invention, the apparatus includes a sleeve positioned so that it blocks fluid flow through a secondary fluid port of the return flow passage. The secondary fluid port is in parallel with the primary fluid port. The member is cooperatively engageable with the sleeve to thereby cause displacement of the sleeve and permit fluid flow through the secondary fluid port. Thus, fluid pressure may be relieved downhole by increasing the effective flow area through the apparatus, beyond that available through the primary fluid port. The processor is programmed to cause the electromechanical device to displace the member into engagement with the sleeve when the fluid pressure reaches a predetermined maximum. In addition, the electromechanical device is capable of resetting the sleeve, so that it again blocks fluid flow through the secondary fluid port.

In still another aspect of the present invention, the electromechanical device is capable of varying the flow area through the primary fluid port to thereby regulate fluid pressure downhole. The member is displaced by the electromechanical device relative to a seat formed adjacent the primary fluid port. In this respect, the member performs the function of a restrictor or a variable fluid choke.

In yet another aspect of the present invention, the member is displaced relative to the primary fluid port to thereby generate pressure pulses in the fluid flowing therethrough. The pulses carry data to the earth's surface in the fluid. The sensor senses one or more fluid properties, such as pressure, temperature, etc., the processor converts the output of the sensor into a signal and transmits the signal to the electromechanical device, which displaces the member in response thereto.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1A:
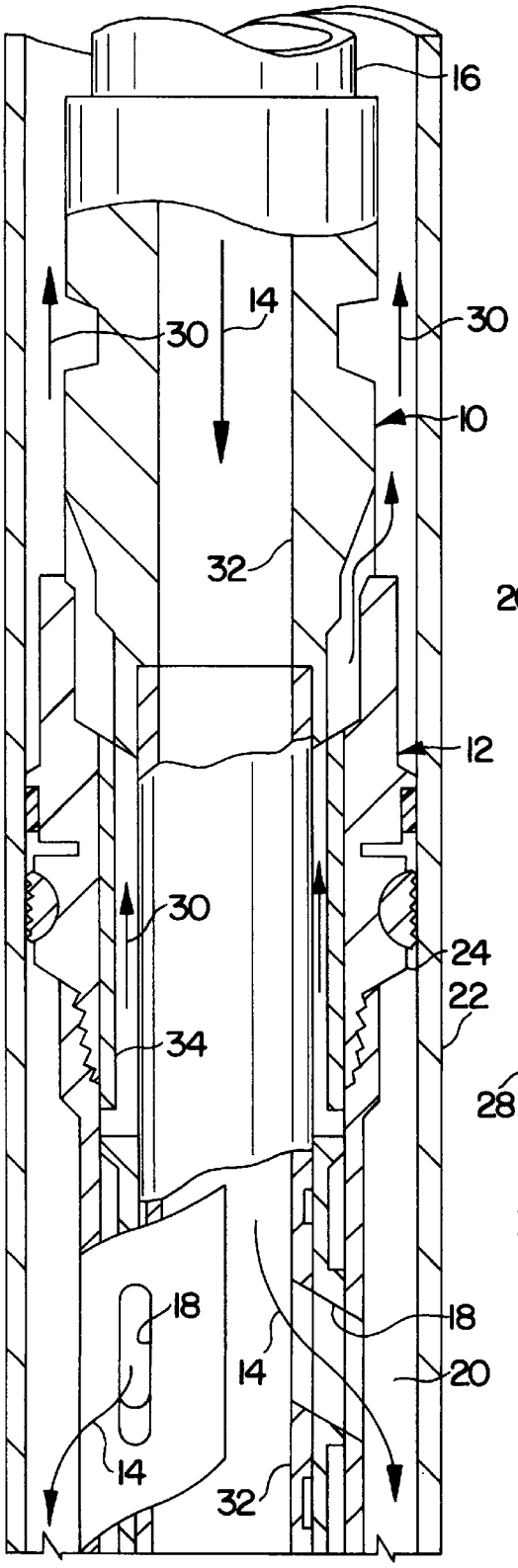
FIGS. 1A–1B are partially elevational and partially cross-sectional views of successive axial portions of a service tool utilized in formation fracturing and/or gravel packing operations.
Figure 1B:
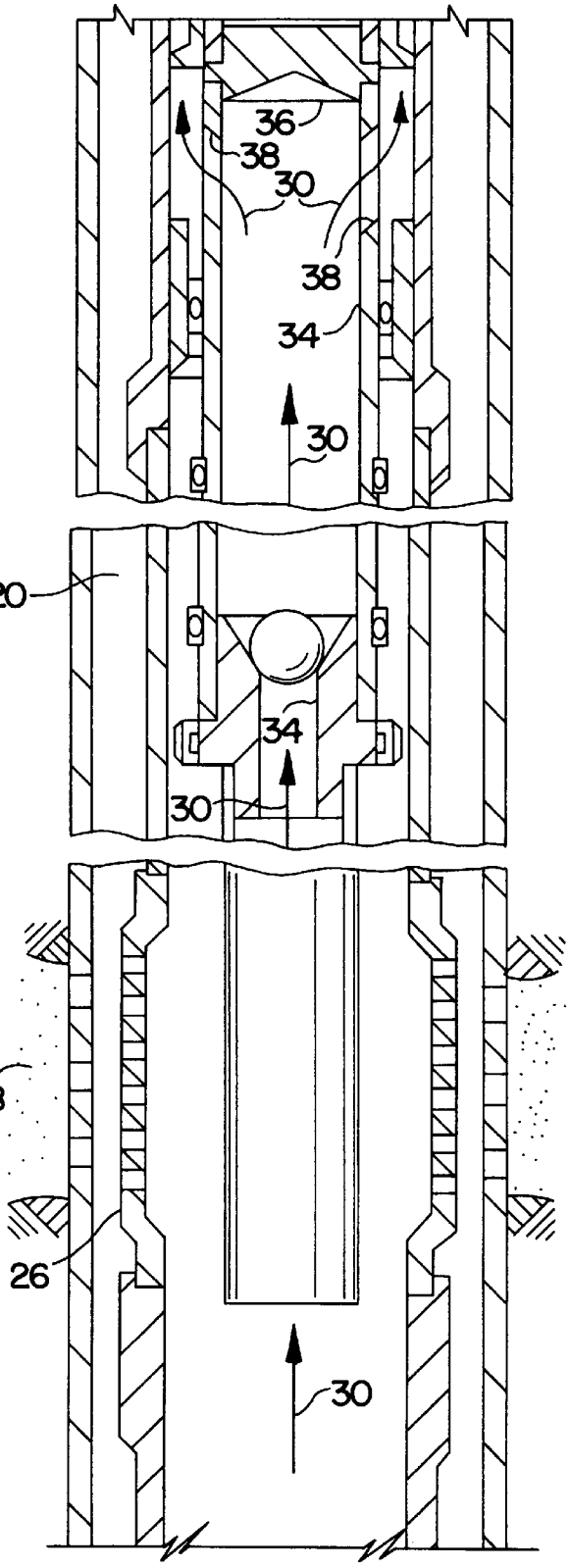

Representatively illustrated in FIGS. 1A–1B is a service tool 10 operatively positioned within an assembly 12. The service tool 10 and assembly 12 are more fully described in U.S. Pat. No. 5,443,117, the disclosure of which is incorporated herein by this reference. The service tool 10 and assembly 12 are shown in FIGS. 1A–1B in a configuration in which a slurry (indicated by arrows 14) is flowed from the earth's surface, through a tubing string or work string 16, anally through an upper portion of the service tool 10, radially outward through ports 18, and into an annulus 20 formed between the assembly 12 and protective casing 72 lining a subterranean well.

The assembly 12 includes a packer 24 and a screen 26 attached to, and extending downwardly from, the packer. The packer 24 is set in the casing 22, with the screen 26 radially opposite a formation 28, or zone of the formation, from which it is desired to produce fluids. The casing 22 has been perforated to permit the fluids to flow into the casing from the formation 28, and also to permit the slurry 14, or a portion of the slurry, to be flowed into the formation.

In a formation fracturing operation, the slurry 14 may be forced into the formation 28 at high pressure to thereby fracture the formation. The slurry 14 in that case contains a proppant, typically sand or a man-made material, for propping the fractures open when the high pressure is subsequently relieved. The proppedopen fractures then provide passageways for fluids to flow from the formation 28 into the casing 22.

In such formation fracturing operations, it is sometimes preferable to prevent a fluid portion (indicated by arrows 30) of the slurry 14 from flowing through the screen 26 and returning to the earth's surface during the fracturing operation. At other times, it may be desired for the fluid portion 30 to be returned to the earth's surface. Thus, it would be advantageous to be able to selectively permit or prevent return flow of the fluid portion 30 through the service tool 10 and assembly 12.

In a gravel packing operation, the slurry 14 is flowed into the annulus 20 and particulate matter or "gravel", typically sand, is deposited in the annulus between the screen 26 and the formation 28. The fluid portion 30 is permitted to flow into the screen 26 and return to the earth's surface through the service tool 10 and assembly 12. At times, gravel packing operations are performed immediately following formation fracturing operations, or otherwise combined therewith, in which case it is advantageous to be able to monitor fluid pressures downhole and to be able to regulate those pressures accurately.

In any event, and no matter the particular completion operation being performed, it is important not to exceed a predetermined maximum fluid pressure within the annulus 20. Overpressurization may cause damage to the service tool 10, the assembly 12, the formation 28, etc. For example, near the end of a formation fracturing job, and while high pressure is still being applied to the slurry 14 from the earth's surface, proppant may begin to accumulate in the annulus 20, restricting the slurry flow into the formation 28 and/or flow of the fluid portion 30 into the screen 26, thereby causing a sudden pressure increase in the annulus 20, service tool 10, etc. Thus, it would be advantageous to be able to immediately relieve any such overpressurization, and it would further be desirable to be able to continue completion operations, even after such an overpressurization has occurred.

Note that the service tool 10 has an upper axial slurry delivery flow passage 32 formed therein generally above the ports 18. The slurry 14 is flowed through this flow passage 32 before flowing outward through the ports 18. The service tool 10 also has a lower axial slurry return flow passage 34 formed therein, which is in fluid communication with the interior of the screen 26. The flow passages 32, 34 are axially separated by a plug 36 attached between the flow passages. When the fluid portion 30 flows upwardly through the flow passage 34, it is diverted radially outwardly through ports 38 just below the plug 36, and into other flow passages in the service tool 10, the assembly 12 and/or between the service tool and assembly. I n the illustrated service tool 10 and assembly 12, the fluid portion 30 flows generally between the service tool and the assembly after exiting the ports 38.

It will be readily appreciated by one of ordinary skill in the art that if flow of the fluid portion 30 through the ports 38 could be regulated and selectively permitted or prevented, a measure of control over the fluid pressure in the annulus 20 would be provided thereby. Additionally, the proportion of the fluid portion 30 returning to the earth's surface or flowing into the formation 28 could also be controlled. For example, if it is desired to flow all of the fluid portion 30 into the formation 28, the ports 38 could be closed, thereby preventing flow of the fluid portion through the return flow passage 34. If it is desired to permit only some of the fluid portion 30 to return to the earth's surface, the ports 38 could be partially opened, thereby regulating flow of the fluid portion through the flow passage 34. Furthermore, if it is desired to relieve fluid pressure in the annulus 20, the ports 38 could be fully opened to thereby provide unrestricted flow of the fluid portion 30 through the return flow passage 34.

Figure 2:
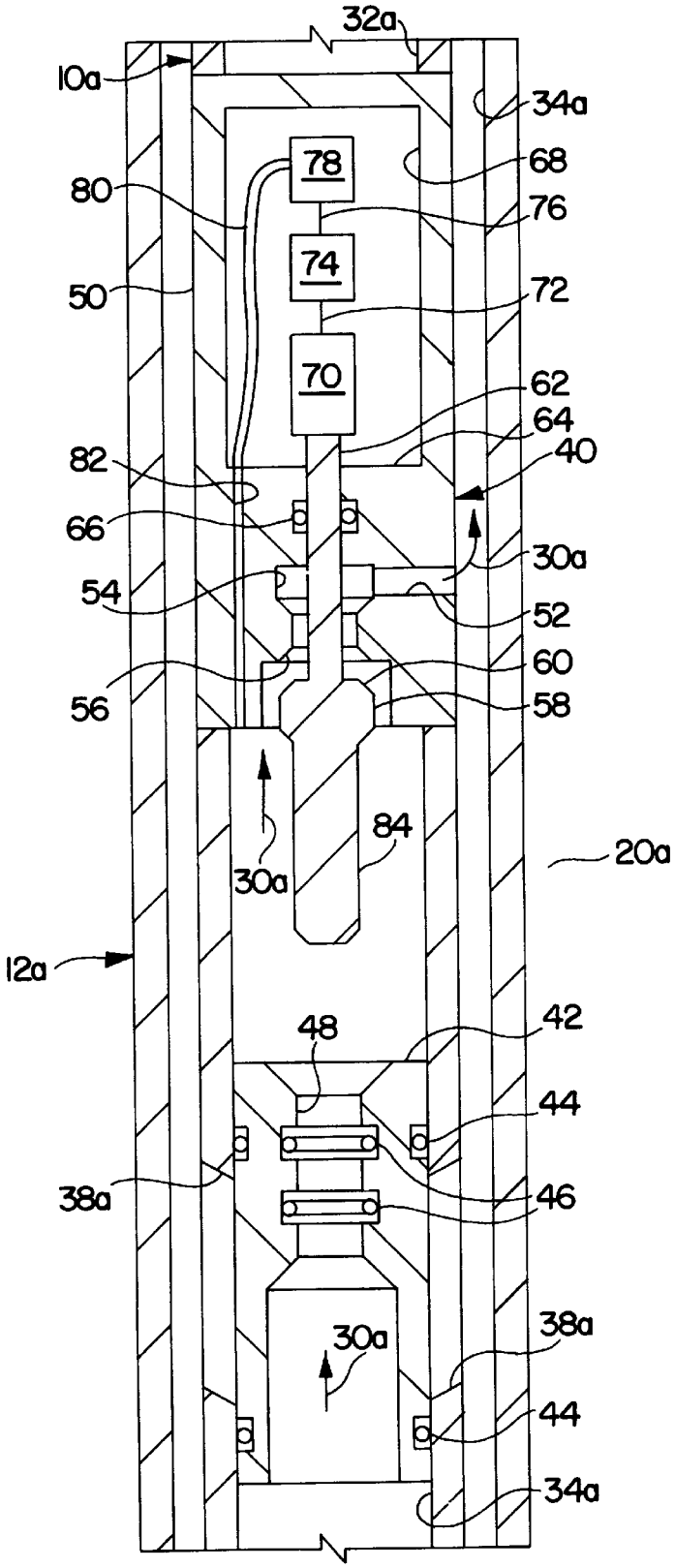
FIG. 2 is a cross-sectional view of an apparatus positioned within the service tool of FIGS. 1A–1B, the apparatus embodying principles of the present invention, and the apparatus being shown in a configuration in which a primary fluid port thereof is fully open.

Referring additionally now to FIG. 2, an apparatus 40 is representatively illustrated, the apparatus embodying principles of the present invention. In the following description of the apparatus 40 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention. In FIG. 2, elements which are similar to those previously described are designated using the same reference numerals, with an added suffix "a".

The apparatus 40 is shown installed in the service tool 10*a* in place of the plug 36. Only an axial portion of the service tool 10*a* and assembly 12*a* is depicted, it being understood that the remainder of the tool 10*a* and assembly 12*a* is similar to the tool 10 and assembly 12 of FIGS. 1A–1B. It is also to be clearly understood that the apparatus 40 may be utilized in other service tools, assemblies, completion equipment, etc., without departing from the principles of the present invention. For example, with suitable modification, the apparatus 40 may be installed in the Multi-Position Tool® manufactured by, and available from, Halliburton Company of Duncan, Okla.

A flow blocking member or sleeve 42 is positioned within the return flow passage 34*a* and prevents flow of the fluid portion 30*a* through the ports 38*a*. Thus, in the apparatus 40, the ports 38*a* are secondary flow ports and are utilized in a manner that will be more fully described hereinbelow. The sleeve 42 carries axially spaced apart circumferential seals 44 externally thereon, axially straddling the ports 38*a*. The sleeve 42 also carries circumferential seals 46 internally thereon adjacent an axial bore 48, which, in the configuration shown in FIG. 2, becomes a part of the return flow passage 34*a*.

The apparatus 40 further includes a housing 50. The housing 50 has a generally radially extending flow port 52 formed through a sidewall portion thereof, which is in fluid communication with a generally axially extending flow passage 54 formed into the housing. It will be readily appreciated that, in the configuration shown in FIG. 2, the fluid portion 30*a* will flow through the flow passage 54 and flow port 52 and, thus, the flow port 52 may be denominated a primary flow port.

A radially inclined downwardly facing circumferential seat 56 is formed internally on the housing 50 about the flow passage 54. Axially reciprocably disposed within the flow passage 54 is a restrictor member 58. The restrictor 58 has a seat 60 formed thereon which is complementarily shaped relative to the seat 56, and which is configured for sealing engagement therewith. As shown in FIG. 2, the seats 56, 60 are spaced apart, thereby permitting flow of the fluid portion 30*a* therebetween. As representatively illustrated, the seats 56, 60 are each made of metal, however, it is to be understood that other suitable materials, such as elastomers, etc., may be utilized instead of, or in addition to, the seats without departing from the principles of the present invention.

A generally rod shaped portion 62 of the restrictor 58 extends axially through a bulkhead 64 of the housing 50. An internal circumferential seal 66 carried on the housing 50 sealingly engages the portion 62, thereby isolating an internal chamber 68 of the housing from fluid communication with the flow passage 34*a* and other fluid passages in the service tool 10*a* and assembly 12*a*. Within the chamber 68, an electromechanical device, such as a conventional solenoid 70, is operatively attached to the portion 62. The solenoid 70 is capable of axially displacing the restrictor 58 relative to the housing 50. It is to be understood that electromechanical devices other than the solenoid 70 may be used to displace the restrictor 58 without departing from the principles of the present invention. For example, an electric motor having an internally threaded armature may be connected to an externally threaded portion 62 so that, when the motor armature is rotated clockwise, the restrictor is axially displaced in one direction, and when the motor is rotated counterclockwise, the restrictor is axially displaced in another, opposite, direction.

The solenoid 70 displaces the restrictor 58 in response to a signal (indicated by line 72) transmitted thereto by a conventional processor 74. The processor 74 may be an integrated circuit, microprocessor, microcomputer, circuit composed of discrete elements, etc., or a combination thereof. In operation, the processor 74 transmits the signal 72 to the solenoid 70 in response to output (indicated by line 76) or a signal from a fluid property sensor 78 interconnected thereto.

The sensor 78 may be any type of sensor, including, but not limited to, a pressure transducer (strain gauge, quartz, piezoelectric, etc.), thermocouple, thermistor, resistivity sensor, etc., or a combination thereof. In the representatively illustrated embodiment, the sensor 78 is a pressure transducer whose output 76 corresponds to fluid pressure within the return flow passage 34*a*. However, it is to be understood that the sensor 78 may sense fluid properties in other fluid passages, areas, etc., without departing from the principles of the present invention. For example, the sensor 78 may sense fluid pressure in the annulus 20*a*.

The sensor 78 is in fluid communication with the return flow passage 34*a* via a fluid conduit 80 extending therebetween. Of course, the conduit 80 may be integrally formed with the housing 50, or otherwise differently routed, without departing from the principles of the present invention. As representatively illustrated, the conduit 80 is interconnected to the return flow passage 34*a* via an internal fluid passage 82 formed axially through the housing 50.

For supplying power to the processor 74, solenoid 70 and/or sensor 78, a conventional battery may be included with the processor or separately provided. Alternatively, power may be supplied via a conventional wireline (not shown) extending to the earth's surface and connected to the service tool 10*a* in a conventional manner.

It will be readily appreciated by one of ordinary skill in the art that, as viewed in FIG. 2, the fluid portion 30*a* is permitted to flow through the housing 50, which thereby forms a part of the return flow passage 34*a*. However, if the restrictor 58 is displaced axially upward by the solenoid 70, so that the seats 56, 60 are sealingly engaged, such fluid communication will be prevented (in which case the restrictor acts as a flow blocking member). In addition, if the restrictor 58 is displaced axially upward by the solenoid 70 so that the flow area between the seats 56, 60 is reduced, flow of the fluid portion 30*a* therethrough will correspondingly be restricted. Thus, the apparatus 40 is capable of selectively opening and closing the return flow passage 34*a*, and is also capable of regulating fluid flow through the return flow passage by varying the flow area between the seats 56, 60.

The processor 74 may be programmed to maintain a desired predetermined fluid pressure in the return flow passage 34*a*. If the sensor 78 indicates that the fluid pressure is less than the desired fluid pressure, the processor 74 may cause the solenoid 70 to displace the restrictor 58 upward, thereby increasing the restriction to fluid flow therethrough. Conversely, if the sensor 78 indicates that the fluid pressure is greater than the desired fluid pressure, the processor 74 may cause the solenoid 70 to displace the restrictor 58 downward, thereby decreasing the restriction to fluid flow therethrough.

In another important aspect of the present invention, the processor 74 may be programmed to cause the solenoid 70 to axially displace the restrictor 58 relative to the housing 50 to thereby generate pressure pulses in the fluid portion 30*a*. For example, with the apparatus 40 configured as shown in FIG. 2, the restrictor 58 may be periodically displaced axially upward to produce a reduction in fluid pressure in the fluid portion 30*a* downstream of the restrictor. Alternatively, the restrictor 58 may be periodically displaced axially downward to produce an increase in fluid pressure in the fluid portion 30*a* downstream of the restrictor.

In a variety of manners, the pressure pulses may be capable of carrying data to the earth's surface. For example, an amplitude, frequency and/or wavelength of the pulses may correspond to a fluid property sensed by the sensor 78. As another example, the pressure pulses may correspond to bits of data in a manner similar to conventional digital data transmission by radio waves. It is to be clearly understood that any manner of data carrying may be utilized, and that the pressure pulses may be "positive" or "negative" as compared to the fluid pressure in the return flow passage upstream of the restrictor 58, without departing from the principles of the present invention. It is also to be clearly understood that, properly configured, the tool 10*a* may communicate and/or transmit data via any of a variety of means, such as electromagnetic waves, acoustic telemetry, optical signals, electrical signals, by wires, fiber optic cables or other lines connected thereto, etc., and that such communication and/or transmission may be with and/or to a location other than the earth's surface.

The processor 74 may be programmed to open, close and/or vary the flow area between the seats 56, 60 in response to variables other than the output of the sensor 78. For example, the processor 74 may be programmed to fully open the apparatus 40 to fluid flow therethrough after a desired elapsed time. These and other manners of programming the processor 74 described herein may be performed by an ordinarily skilled electrical technician.

A generally rod shaped member 84 extends axially downward from the restrictor 58 and may be separately or integrally formed therewith. The member 84 is configured for cooperative engagement with the bore 48 and sealing engagement with the seals 46. The solenoid 70 is capable of displacing the member 84 axially downward to thereby engage the sleeve 42 in response to the signal 72 transmitted by the processor 74. Preferably, such engagement is accomplished in response to the output 76 of the sensor 78, which indicates that a predetermined maximum fluid pressure is present in the return flow passage 34*a*.

Figure 3:
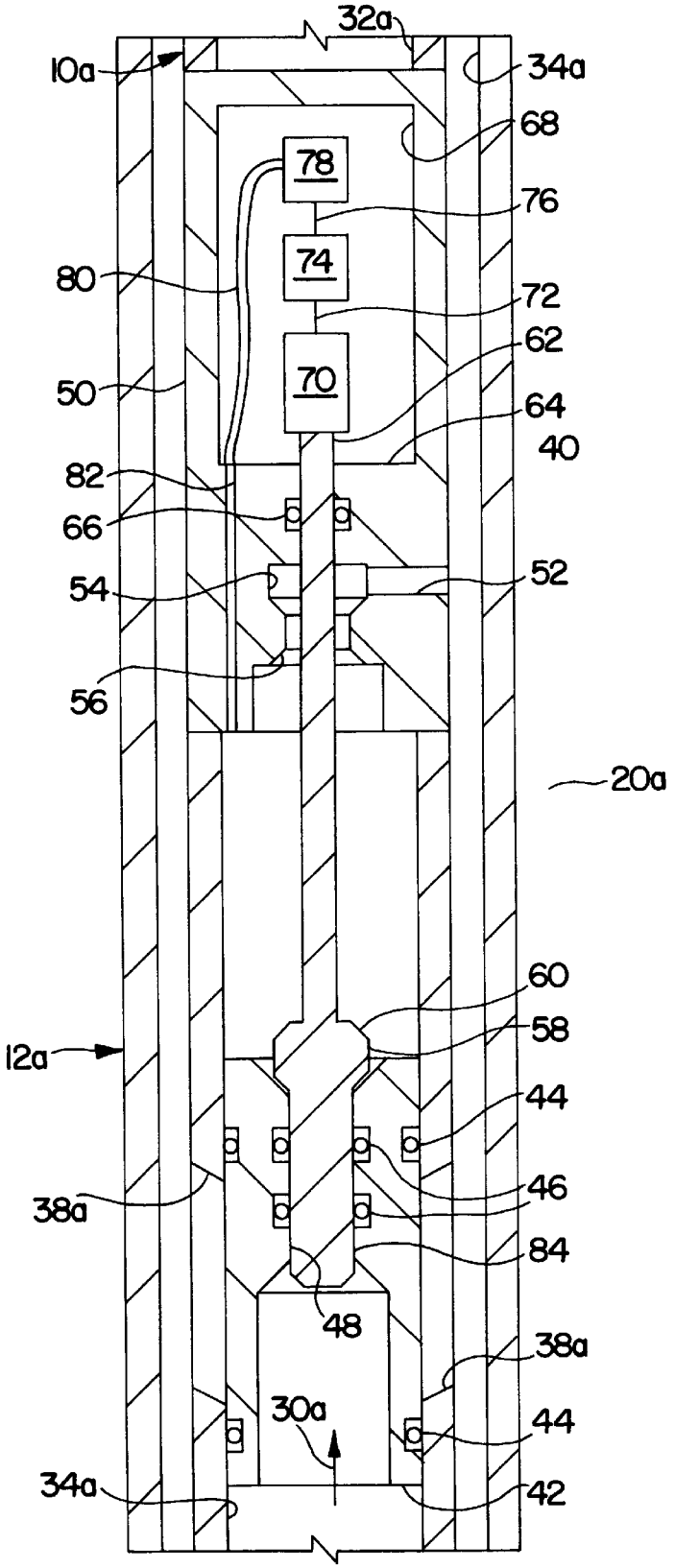
FIG. 3 is a cross-sectional view of the apparatus of FIG. 2, the apparatus being shown in a configuration in which one member thereof has sealingly engaged another member.

Referring additionally now to FIG. 3, the apparatus 40 is representatively illustrated in a configuration in which the member 84 is received in the bore 48, sealingly engaging the seals 46. Note that, with the member sealingly engaged with the sleeve 42, fluid flow through the return flow passage 34*a* is temporarily prevented. However, this condition is only momentary, since it will be readily appreciated that a pressure differential will be formed immediately across the sleeve 42 and member 84, the pressure differential biasing the sleeve and member axially upward. Of course, shear pins or other releasable attachment devices may be utilized to releasably prevent displacement of the sleeve 42 relative to the service tool 10*a*.

The member 84 is displaced into engagement with the sleeve 42 when it is desired to open the secondary flow ports 38*a*. For example, if an overpressurization is detected in the return flow passage 34*a* by the sensor 78. The pressure differential thus created will displace the member 84 and sleeve 42 axially upward, uncovering the ports 38*a*, and thereby permitting unrestricted flow of the fluid portion 30*a* therethrough. In this manner, any excess fluid pressure may be relieved to the return flow passage 34*a* downstream of the ports 38*a*.

Note that the ports 52, 38*a* are in parallel with each other and in series with the remainder of the return flow passage 34*a* Therefore, either of the ports 52, 38*a* may form a part of the return flow passage 34*a*. The primary port 52 is preferably utilized in normal operations wherein it is desired to regulate or selectively permit and prevent fluid flow through the return flow passage 34*a*. The secondary ports 38*a* are preferably utilized to provide unrestricted fluid flow through the return flow passage. Of course, with appropriate modification, fluid flow may be permitted through both the primary and secondary ports 52, 38*a* simultaneously, however, since the secondary ports already provide unrestricted flow in the illustrated embodiment, such modification is unnecessary.

Figure 4:
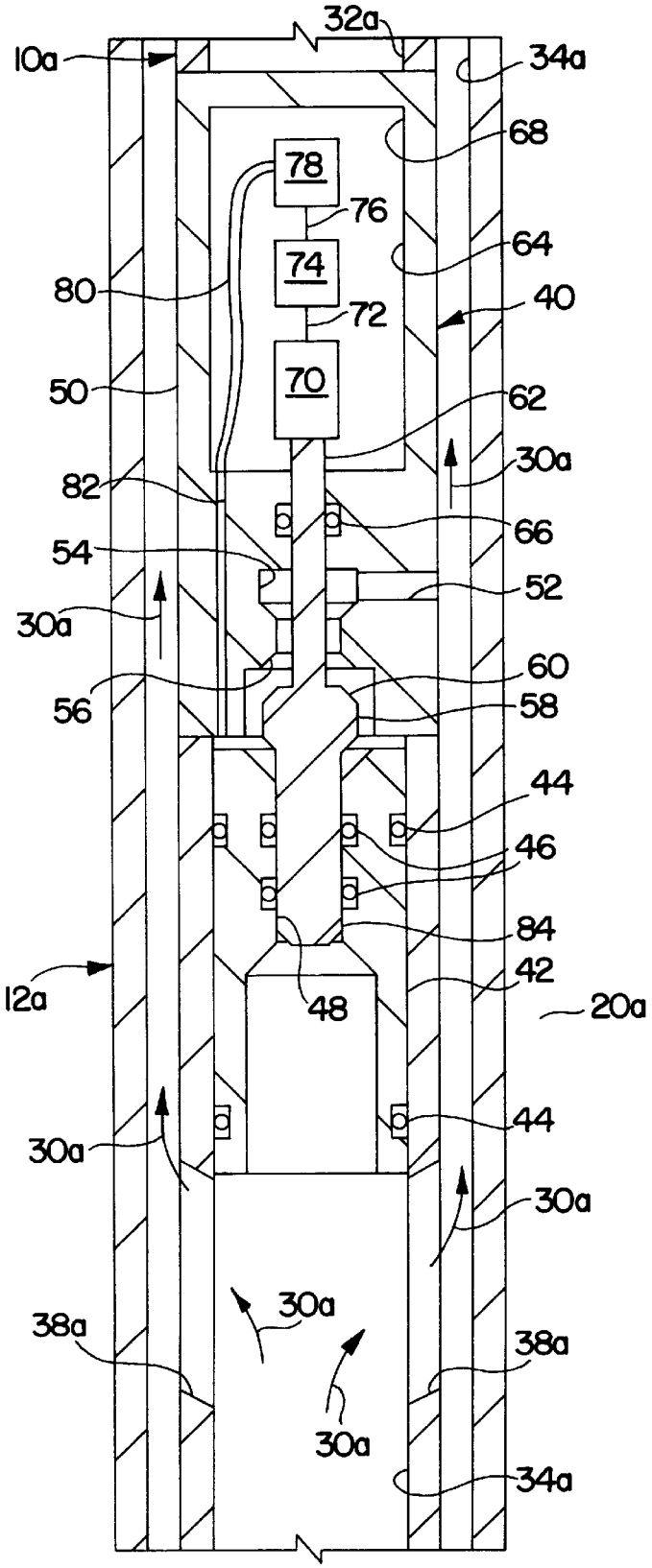
FIG. 4 is a cross-sectional view of the apparatus of FIG. 2, the apparatus being shown in a configuration in which a secondary fluid port thereof has been opened.

Referring additionally now to FIG. 4, the apparatus 40 is representatively illustrated in a configuration in which the pressure differential across the sleeve 42 and member 84 has axially upwardly displaced them relative to the service tool 10*a*. The secondary ports 38*a* are now open to fluid flow therethrough. The fluid portion 30*a* is now permitted to flow unrestricted upward through the return flow passage 34*a*. Note that the sensor 78 is now in fluid communication with the return flow passage 34*a* downstream of the secondary ports 38*a*, and is capable of sensing when the excess fluid pressure has been relieved.

Once the excess fluid pressure has been relieved, the apparatus 40 may be returned to its configuration shown in FIG. 2 by actuating the solenoid 70 to axially downwardly displace the member 84 and sleeve 42 relative to the service tool 10*a*. Flow of the fluid portion 30*a* should be ceased while the sleeve 42 is positioned across the secondary ports 38*a*, to prevent producing another pressure differential across the sleeve and member 84. When the sleeve 42 is properly positioned, the solenoid 70 may be actuated to displace the member 84 axially upward out of engagement with the sleeve 42.

For the purpose of structural engagement and disengagement between the sleeve 42 and the member 84, either or both of them may be provided with a variety of latching devices, such as collets, keys, lugs, etc., without departing from the principles of the present invention.

Thus has been described the tool 10*a* and apparatus 40 incorporated therein which selectively permits and prevents fluid flow through the return flow passage 34*a* downhole and variably regulates such fluid flow downhole without requiring manipulation of the work string 16, which transmits fluid property data to the earth's surface via pressure pulses in the fluid portion 30*a*, which is capable of relieving excess fluid pressure, and which is capable of returning to normal operation after relieving such excess fluid pressure.

Of course, modifications, substitutions, additions, deletions, etc., may be made to the above described representative embodiment of the invention which would be obvious to one of ordinary skill in the art, and such are contemplated by the principles of the present invention. Accordingly, the foregoing detailed description is to be clearly understood as being given by way of illustration and example only, the spirit and scope of the present invention being limited solely by the appended claims.

What is claimed is:

1. Apparatus for completing a subterranean well, the apparatus comprising:

a packer settable within a wellbore of the well;

a screen attached to the packer; and a service tool positioned at least partially within the packer, the service tool having a slurry delivery flow passage for delivering a slurry to an annulus formed generally radially between the screen and the wellbore, a fluid return flow passage for returning a fluid portion of the slurry to the earth's surface after the fluid portion has flowed inwardly through the screen, a flow blocking member selectively positionable relative to a flow port of the return flow passage in a first position in which fluid flow is prevented through the flow port and a second position in which fluid flow is permitted through the flow port, a sensor capable of sensing fluid pressure within the return flow passage, a processor interconnected to the sensor, the processor transmitting a signal in response to a level of fluid pressure indicated by the sensor, an engagement member, and an electromechanical device interconnected to the processor, the device displacing the engagement member in response to the processor signal to engage the blocking member and thereby cause displacement of the blocking member from the first position to the second position.

2. The apparatus according to claim 1, wherein the flow port is formed through a sidewall portion of a generally tubular portion of the service tool, the flow port providing fluid communication between the interior of the tubular portion and the exterior of the tubular portion when the blocking member is in the second position.

3. The apparatus according to claim 2, wherein the interior of the tubular portion is in fluid communication with the interior of the screen.

4. The apparatus according to claim 3, wherein the exterior of the tubular portion is in fluid communication with an annulus formed radially between the packer and the service tool.

5. Apparatus for completing a subterranean well, the apparatus comprising:

a packer settable within a wellbore of the well;

a screen attached to the packer; and a service tool positioned at least partially within the packer, the service tool having a slurry delivery flow passage for delivering a slurry to an annulus formed generally radially between the screen and the wellbore, a fluid return flow passage for returning a fluid portion of the slurry to the earth's surface after the fluid portion has flowed inwardly through the screen, a flow restrictor, a sensor capable of sensing fluid pressure within the return flow passage, a processor interconnected to the sensor, the processor transmitting a signal in response to a level of fluid pressure indicated by the sensor, and an electromechanical device interconnected to the processor, the device displacing the flow restrictor in response to the processor signal to thereby restrict fluid flow through the return flow passage.

6. The apparatus according to claim 5, wherein the flow restrictor has a first surface formed thereon, and further comprising a second surface disposed about the return flow passage, the device being capable of varying the distance between the first and second surfaces to correspondingly vary restriction of flow through the return flow passage.

7. The apparatus according to claim 6, wherein the first and second surfaces are sealingly engageable to thereby prevent fluid flow through the return flow passage.

8. The apparatus according to claim 5, wherein the processor is programmed to maintain a predetermined fluid pressure in the flow passage by varying the signal to thereby cause the device to displace the flow restrictor in a first direction when the fluid pressure in the return flow passage is greater than the predetermined fluid pressure, and to displace the flow restrictor in a second direction when the fluid pressure in the return flow passage is less than the predetermined fluid pressure.

* * * * *